US005117194A

United States Patent [19]

Nakanishi et al.

[11] Patent Number: 5,117,194

[45] Date of Patent: May 26, 1992

[54] DEVICE FOR ACCELERATING AND STORING CHARGED PARTICLES

[75] Inventors: Tetsuya Nakanishi; Tadatoshi Yamada; Shunji Yamamoto; Tetsuya Matsuda; Toshie Ushijima, all of Amagasaki, Japan

[73] Assignee: Mitsubishi Denki Kabushiki Kaisha, Japan

[21] Appl. No.: 398,419

[22] Filed: Aug. 25, 1989

[30] Foreign Application Priority Data

Aug. 26, 1988 [JP] Japan ..... 63-213220
Dec. 27, 1988 [JP] Japan ..... 63-327612

[51] Int. Cl.[5] ..... H05H 13/04

[52] U.S. Cl. ..... 328/233; 328/235; 335/214

[58] Field of Search ..... 328/235, 233; 335/214

[56] References Cited

U.S. PATENT DOCUMENTS 4,223,355 9/1980 Lerch et al. ..... 335/214 X
4,490,675 12/1984 Knuettel et al. ..... 335/214 X
4,680,565 7/1987 Jahnke ..... 328/235 X
4,707,676 11/1987 Saitou et al. ..... 335/216
4,737,727 4/1988 Yamada et al. ..... 328/235
4,780,683 10/1988 Nakata ..... 328/235
4,783,634 11/1988 Yamamoto et al. ..... 328/235
4,808,941 2/1989 Marsing ..... 328/235
4,931,744 6/1990 Sonobe et al. ..... 328/235

*Primary Examiner*—Palmer C. DeMeo
*Attorney, Agent, or Firm*—Leydig, Voit & Mayer

[57] ABSTRACT

A device for accelerating and storing charged particles of the present invention comprises a vacuum duct which has two opposite linear portions and two opposite curved portions respectively connected to the linear portions and which functions to maintain the orbit of revolution of the charged particles in a vacuum; an accelerating device for accelerating charged particles which is disposed on the orbit of the charged particles; a pair of bending magnets which are respectively disposed on the curved portions of the vacuum duct; and a pair of quadrupole electromagnets which are respectively disposed on the linear portions of the vacuum duct and at least one of which is disposed at a position at a given distance from the center of the corresponding linear portion.

20 Claims, 11 Drawing Sheets

DEVICE FOR ACCELERATING AND STORING CHARGED PARTICLES

BACKGROUND OF THE INVENTION

1. Field of the Invention

The present invention relates to a device for accelerating and storing charged particles which is used, for example, for generating synchrotron radiation.

2. Description of the Related Art

FIG. 1 shows the conventional device for accelerating and storing charged particles shown in REPORT OF THE SECOND WORKSHOP ON SYNCHROTRON RADIATION SOURCES FOR X-RAY LITHOGRAPHY, BNL 38789, INFORMAL REPORT. In the drawing, reference numeral 1 denotes bending magnets, i.e., superconductive bending magnets, which are provided with a magnetic field gradient for bending and converging a charged particle beam; reference numeral 2 denotes quadrupole electromagnets for converging a charged particle beam; reference numeral 3 denotes a high frequency accelerating cavity for accelerating charged particles; reference numeral 4 denotes a tubular vacuum duct for maintaining a revolution orbit of charged particles in a vacuum; and reference numeral 5 denotes ports for emitting radiation.

The vacuum duct 4 has two opposite linear portions and two opposite semicircular curved portions, charged particles being made to circulate therein. For example, one bending magnet 1 is disposed in each of the curved portions of the vacuum duct 4, and three quadrupole electromagnets 2 are disposed in each of the linear portions.

In this device, the beam energy is about 0.6 GeV, and typically the length of each linear portion la is 2.9 m, the distance between the respective quadrupole electromagnets 2 lb of 1.1 m, the width of the device lc is 1.7884 m, and the length of the device ld is 4.6884 m.

The operation of the device will now be described.

Although not shown in FIG. 1, two electromagnets, called a septum electromagnet and a kicker electromagnet, are interposed between the adjacent quadrupole electromagnets 2 in the linear portion for the purpose of introducing charged particles in the vacuum duct 4. The orbits of the charged particles introduced by these electromagnets are bent and converged by each of the bending magnets 1 and further converged by each of the quadrupole electromagnets 2 so as to make a stable revolution in the vacuum duct 4. The charged particles are then accelerated by the high frequency accelerating cavity 3 so that the energy thereof is increased. The intensity of the magnetic field produced by the bending magnets 1 and the quadrupole electromagnets 2 is increased in correspondence with the increase in the energy of the charged particles so that the orbit of the charged particles is kept constant. After the final energy has been attained, the intensity of the magnetic field produced by the bending magnets 1 and the quadrupole electromagnets 2 is made to be constant. Although the charged particles emit radiation from the ports 5 during passage through the bending magnets 1, thereby losing energy, this energy loss is made up in the high frequency accelerating cavity 3 so that the charged particles can continuously circulate through the vacuum duct 4 and supply radiation for a long time.

Three quadrupole electromagnets 2, which each have the function of converging charged particles, are provided in each of the linear portions of the vacuum duct 4. This is because there is no position at which the size of a charged particle beam is maximum in each of the bending magnets 1.

However, the conventional device for accelerating and storing charged particles configured as described above involves the problem that the length of each linear portion of the vacuum duct 4 is increased to some extent owing to the use of many quadrupole electromagnets 2 and further increased owing to the provision of the septum electromagnet and the kicker electromagnet which are necessary to inject the charged particles. These increases in length lead to an increase in the overall size of the device. The conventional device also involves the problem that the quadrupole electromagnets 2 are easily significantly affected by the leakage magnetic field of the bending magnets 1 because they are disposed near the bending magnets 1, and it is difficult to make a countermeasure against this.

SUMMARY OF THE INVENTION

The present invention has been achieved with a view to resolving the problems of conventional devices, and it is an object of the present invention to provide a small-sized device with a high level of reliability for accelerating and storing charged particles.

A device for accelerating and storing charged particles in accordance with the present invention comprises a vacuum duct which has two opposite linear portions and two opposite curved portions respectively connected to the linear portions and which functions to maintain the orbit of revolution of the charged particles in a vacuum, an accelerating means for accelerating charged particles which is disposed on the orbit of the charged particles, bending magnets which are respectively disposed on the curved portions of the vacuum duct, and a pair of quadrupole electromagnets with one of the pair being the only quadrupole electromagnet disposed in one of the linear portions and the other of the pair being the only quadrupole electromagnet disposed in the other linear portion and at least one of the pair being disposed at a position at a given distance from the center of the corresponding linear portion.

DESCRIPTION OF THE PREFERRED EMBODIMENT

Figure 1:
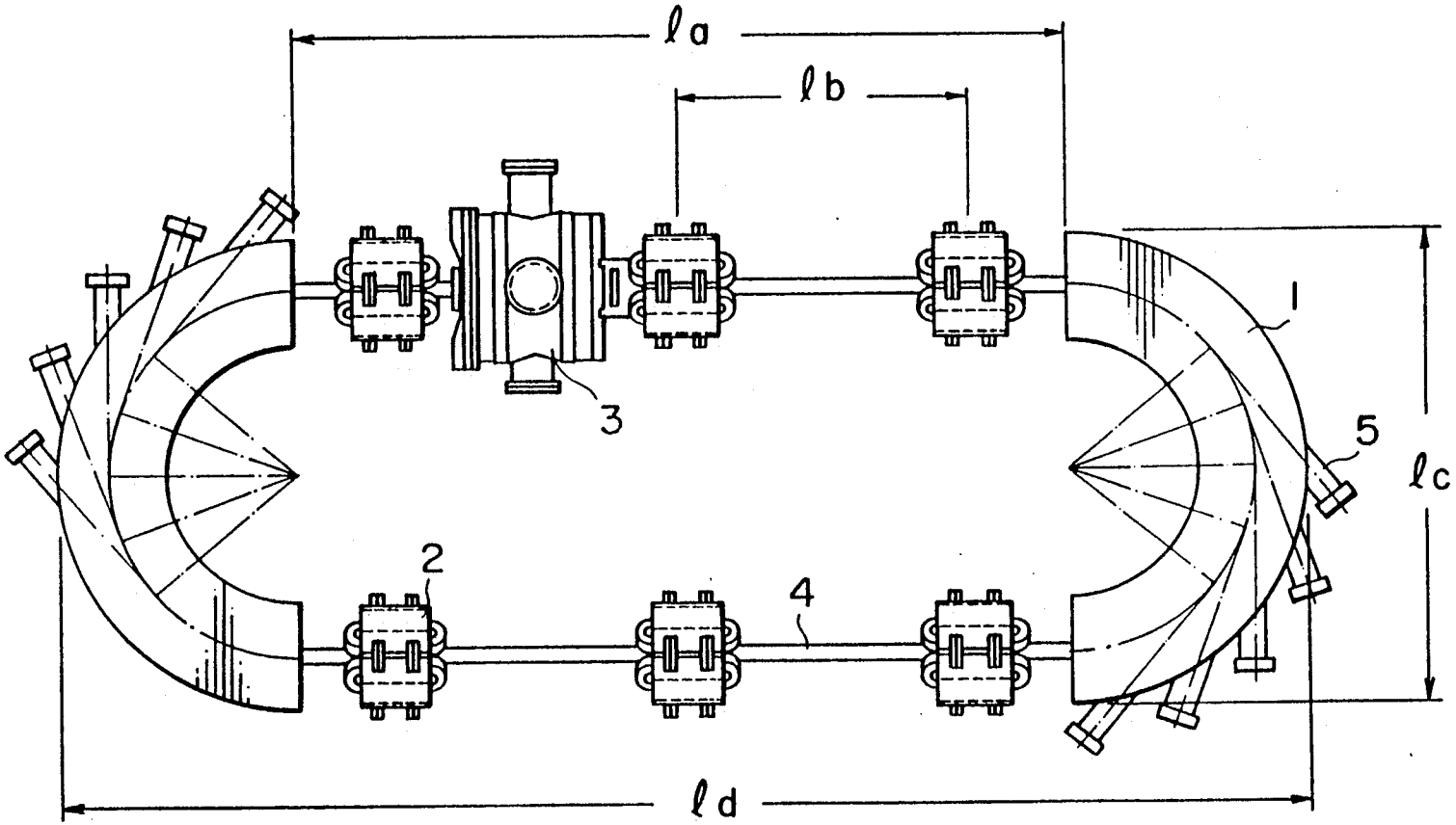
FIG. 1 PRIOR ART
FIG. 1 is a plan view of a conventional device for accelerating and storing charged particles.

An embodiment of the present invention will be described below with reference to the attached drawings In FIG. 2, a device for accelerating and storing charged particles has a vacuum duct 14 for maintaining an orbit 19 of circulating charged particles in a vacuum. The vacuum duct 14 comprises two opposite linear portions 14*a* and two opposite curved portions 14*b* which are respectively connected to the linear portions 14*a*. In each of the curved portions 14*b* of the vacuum duct 14 is provided a bending magnet 11 provided with a magnetic field gradient for bending charged particles and converging them. For example, a superconductive magnet is used as each of the bending magnets 11. On the other hand, a quadrupole electromagnet 12 for converging charged particles is provided in each of the linear portions 14*a* of the vacuum duct 14. These quadrupole electromagnets 12 are disposed at positions at the same distance from the centers of the linear portions 14*a* in the same direction with respect to the direction of travel of the charged particles. A septum electromagnet 16 for injecting the charged particles into the vacuum duct 14 is disposed in one of the linear portions 14*a* of the vacuum duct 14, while a high frequency accelerating cavity 13 for accelerating charged particles and a kicker electromagnet 18 for correcting the orbit of the charged particles injected through the septum electromagnet 16 are disposed in the other straight portion 14*a*. In the drawing, reference numeral 17 denotes a septum coil provided in the septum electromagnet 16. Further, a plurality of ports 15 for emitting radiation are connected to the curved portions 14*b* of the vacuum duct 14.

The device of this embodiment is so formed as to cope with beam energy of about 0.8 GeV and has such a size that the length La of each linear portion 14*a* of the vacuum duct 14 is 2.75 m, the distance Lb between each bending magnet 11 and each quadrupole electromagnet 12 is 0.8 m, and the length Lc of each quadrupole electromagnet 12 is 0.2 m.

Figure 3:
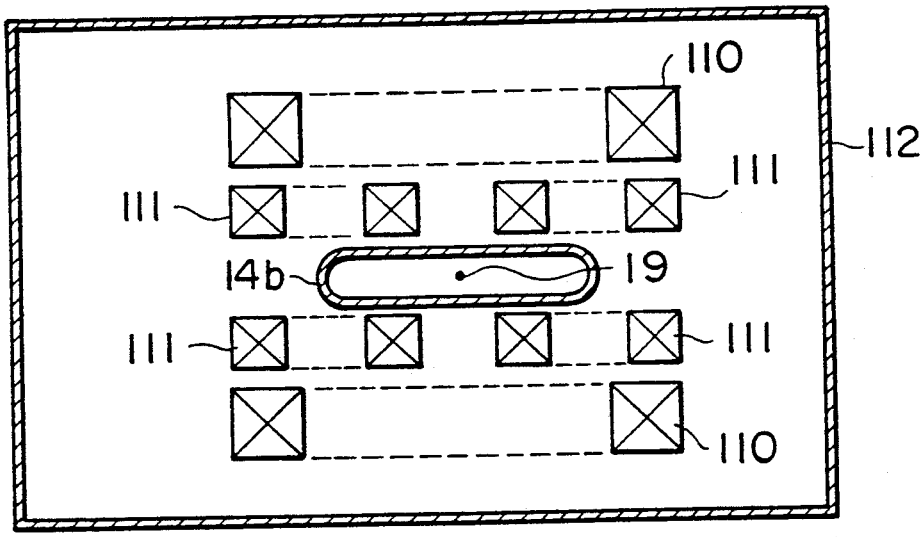
FIG. 3 is a sectional view taken along the line I—I in FIG. 2.

FIG. 3 is a sectional view of each bending magnet 11 taken along a surface vertical to the orbit 19 of the charged particles. As shown in FIG. 3, main deflecting coils 110 are disposed so as to hold each of the curved portions 14*b* of the vacuum duct 14 therebetween in the longitudinal direction. These main deflecting coils 110 form a flat distribution of a magnetic field in a surface vertical to the orbit 19 of the charged particles so as to deflect the charged particles. Shim coils 111 are interposed between each of the curved portions 14*b* and the main deflecting coils 110 for the purpose of creating a quadrupole component in a surface vertical to the orbit 19. The vacuum duct 14, the main deflecting coils 110 and the shim coils 111 are accommodated in a cryostat 112. This cryostat 112 is a container for keeping the main deflecting coils 110 and the shim coils 111 at a very low temperature.

A description will now be given of the operation of the device. First charged particles are bent in the septum electromagnet 16 and injected into the vacuum duct 14. If the path of the injected charged particles is not further modified, however, the charged particles strike against the septum coil 17 and thus disappear because they are always returned to the initial position after several revolutions. Thus, the orbit of the charged particles injected is corrected by the kicker electromagnet 18 so that the charged particles do not strike the septum coil 17. As a result, the charged particles injected are bent and converged by each of the bending magnets 11 and further converged by each of the quadrupole electromagnets 12 so that the charged particles make a stable revolution in the vacuum duct 14. The charged particles are then accelerated in the high frequency accelerating cavity 13 so that the energy thereof is increased. The magnetic field intensity of the bending magnets 11 and the quadrupole electromagnets 12 is increased in correspondence with the increase in the energy of the charged particles so that the orbit 19 of revolution of the charged particles can be maintained at a constant state. After final energy has been attained, the magnetic field intensity of the bending magnets 11 and the quadrupole electromagnets 12 is made to be constant. The charged particles emit radiation from the ports 15 when passing through the bending magnets 11 and thereby lose energy, however, the charged particles continuously circulate through the vacuum duct 14 and supply radiation for a long time because the energy loss is made up in the high frequency accelerating cavity 13.

In this embodiment, since only one quadrupole electromagnet 12 is disposed in each of the linear portions 14*a* of the vacuum duct 14, the length of each of the linear portions 14*a* is reduced, hence the overall size of the device is reduced. In addition, since the quadrupole electromagnets 12 are respectively disposed at positions at a given distance from the centers of the linear portions 14*a*, the space where the septum electromagnet 16 and the kicker electromagnet 18 and so on are provided is widened, and it is thus easy to design the device. Further, each of the quadrupole electromagnets 12 can be disposed at a position at a distance from each of the bending magnets 11 which is greater than in conventional devices, and thus the effect of the leakage magnetic field of each bending magnet 11 can be reduced, resulting in an easy countermeasure against this. It is also possible to dispose a beam monitor or the like in the widened spaces between the respective bending magnets 11 and the respective quadrupole electromagnets 12. The results of comparison between the embodiment and a conventional device are shown in the table given below. As can be seen from the table. the beam energy of the embodiment is increased, while the size of the device is reduced. Furthermore, the distances between the respective quadrupole electromagnets 12 and the respective bending magnets 11 can be increased, as shown in the table.

| | Conventional Device | Device of embodiment |
|---|---|---|
| Beam energy | 0.6 GeV | 0.8 GeV |
| Length of linear portion | 2.9 m | 2.75 m |
| Distance between bending magnet | 0.25 m | 0.8 m |

-continued

| | Conventional Device | Device of embodiment |
|---|---|---|
| and quadrupole electromagnet | | |

In addition, since the quadrupole electromagnets 12 are respectively disposed at the positions which deviate from the centers of the linear portions 14*a* of the vacuum duct 14, it is possible to prevent a position at which the beam size of the circulating charged particles is maximum from being present in each of the bending magnets 11.

In the above-described embodiment, since the two quadrupole electromagnets 12 are respectively disposed at positions which are at the same distance from the centers of the linear portions 14*a* of the vacuum duct 14 in the same direction with respect to the direction of travel of the charged particles, the period of arrangement of the electromagnets is 2. However, one of the quadrupole electromagnets 12 may be disposed at a position deviating from the center of the corresponding linear portion 14*a*, with the other being disposed at the center of the corresponding linear portion 14*a*, so that the period of arrangement of the electromagnets is 1. In this case, however, it is necessary to prevent strong resonance from taking place in the charged particles circulate around the orbit 19.

The charged particles circulate around the orbit 19 while vibrating in the horizontal and vertical directions, the number of vibrations (referred to as "tune" hereinafter) during one revolution on the orbit 19 being determined by the magnetic field intensity of the bending magnets 11 and the quadrupole electromagnets 12, the distance between the adjacent electromagnets and so on. If this tune is determined to be an unsuitable value, resonance takes place in the charged particles owing to an error magnetic field of the bending magnets 11 and the quadrupole electromagnets 12, which leads to the occurrence of beam loss. A condition for resonance is generally expressed by the following equation:

$$l\nu + m\nu y = n$$

wherein l, m, n=0, ±1, ±2, . . . and $\nu x$ and $\nu y$ respectively denote the tune in the horizontal and vertical directions.

In particular, if the period of electromagnet arrangement is N and the following equation is satisfied:

$$n = N \times \text{an integer},$$

strong resonance called structural resonance takes place. It is therefore necessary to take care to avoid such resonance from taking place. In other words, such structural resonance can be easily avoided by employing 2 rather than 1 as the period N of the electromagnet arrangement. For example, in the embodiment shown in FIG. 2, since $\nu x = 1.4$ and $\nu y = 0.4$ and thus n=5 when l=3 and m=2, resonance easily takes place in the case of configuration with N=1.

Figure 2:
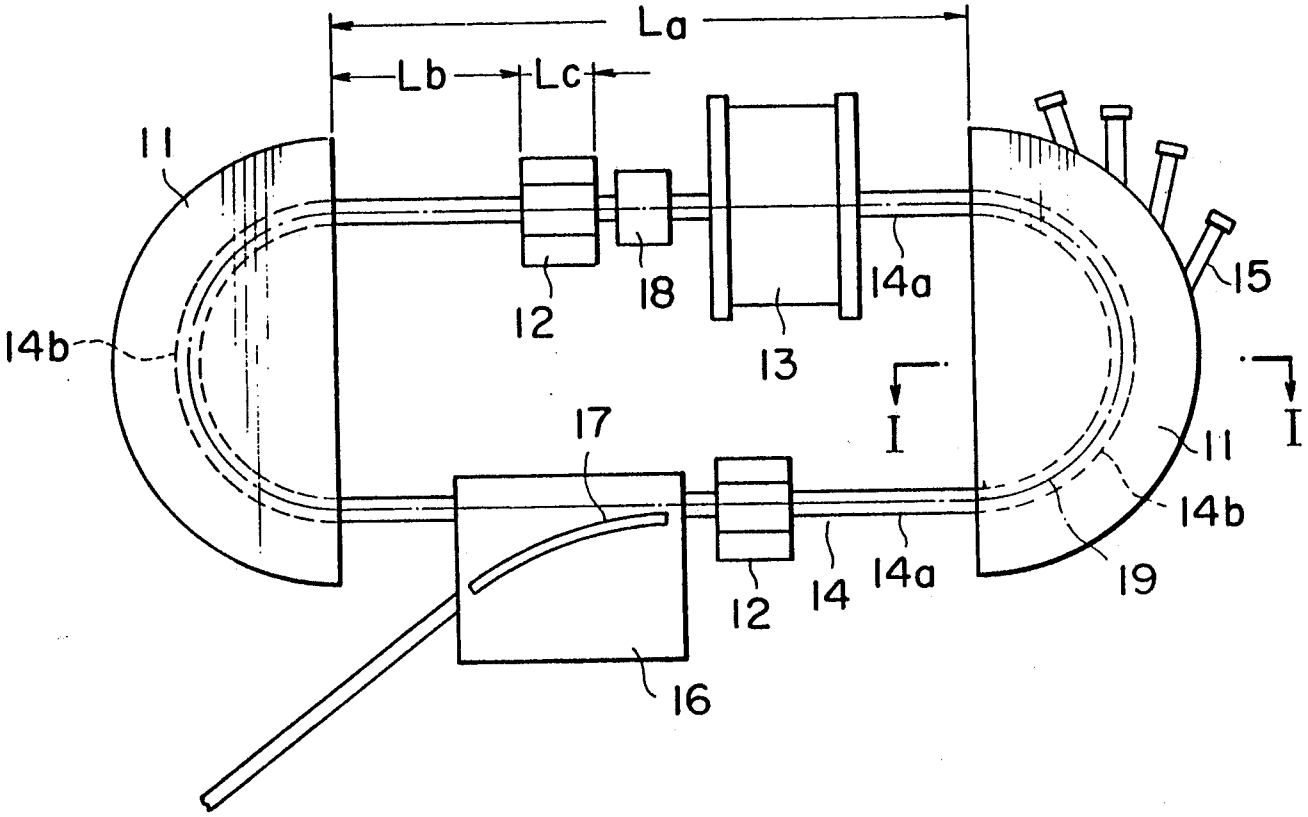
FIG. 2 is a plan view of a device for accelerating and storing charged particles in accordance with an embodiment of the present invention.

The kicker electromagnet 18 need not be always placed between one of the quadrupole electromagnets 12 and the high frequency accelerating cavity 13, as shown in FIG. 2, and it may be placed in other portions of the vacuum duct 14.

Figure 4:
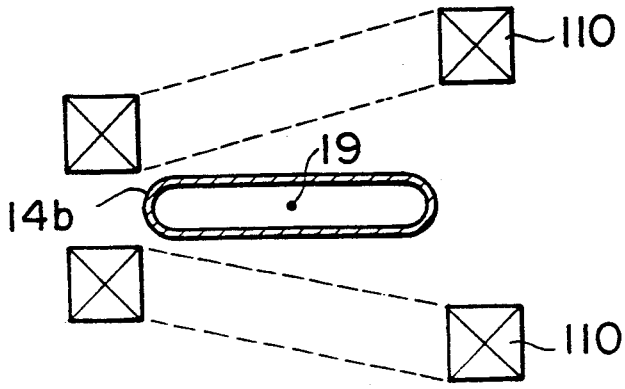
FIG. 4 is a sectional view of a first modification of a bending magnet.

Furthermore, if the two main deflecting coils 110 are disposed at a certain angle so as to open toward the outside of each of the curved portions 14*b* of the vacuum duct 14, as shown in FIG. 4, a quadrupole component can be created without using any shim coil, resulting in simplification of the structure of the device.

Figure 4A:
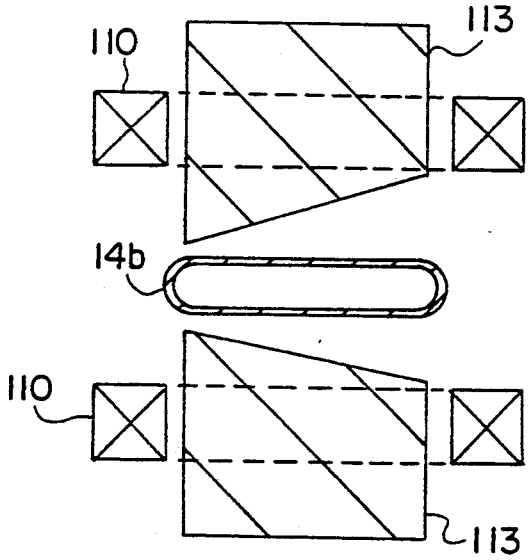
FIG. 4*a* is a sectional view of a further modification of a bending magnet.

A quadrupole component can also be produced by inserting an iron core 113 into each of the two main deflecting coils 110 which are disposed in parallel with each other and disposing the pole faces of the iron cores near the vacuum duct 14, as well as disposing them so as to open toward the outside of each of the curved portions 14*b* of the vacuum duct 14, as shown in FIG. 4*a*. Alternatively, such iron cores may be used in combination with the shim coils 111 shown in FIG. 3, or iron cores may be respectively inserted into the main deflecting coils 110 shown in FIG. 4.

Figure 5:
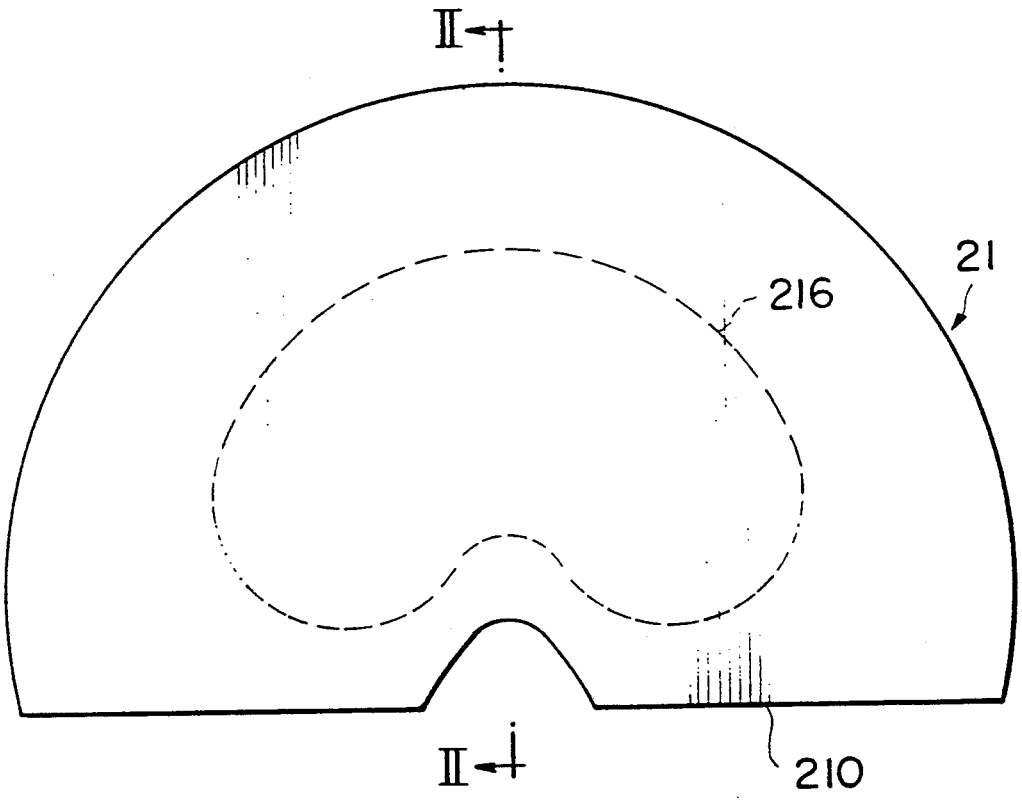
FIG. 5 is a sectional view of a second modification of a bending magnet.
Figure 6:
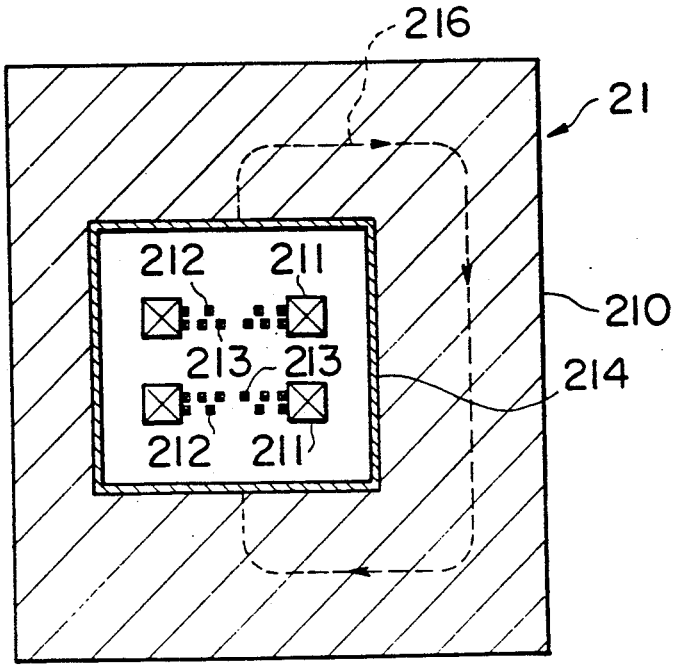
FIG. 6 is a sectional view taken along the line II—II in FIG. 5.
Figure 7:
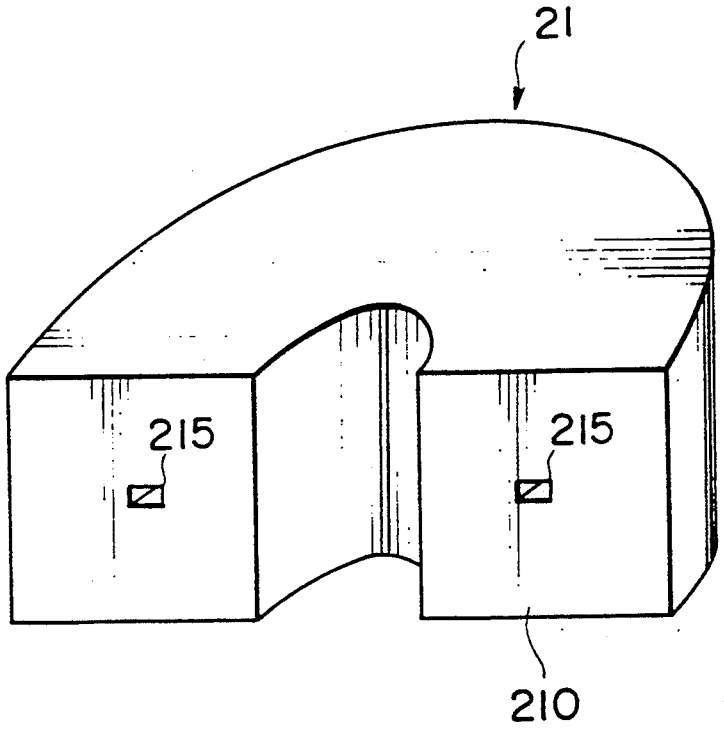
FIG. 7 is a perspective view of the bending magnet shown in FIG. 5.

As shown in FIG. 5, it is also possible to use a superconductive bending magnet 21 covered with a magnetic shield body 210. The cross-section of the bending magnet 21 is shown in FIG. 6. Quadrupole compensating shim coils 212 and sexpole compensating shim coils 213 are disposed on the insides of main deflecting coils 211, these coils 211 to 213 being accommodated in a cryostat 214. The magnetic shield body 210 is provided on the external periphery of the cryostat 214 so as to surround it. As shown in FIG. 7, the magnetic shield body 210 is provided with windows 215 through which a vacuum duct (not shown) is passed, as well as a plurality of ports (not shown) for emitting radiation.

Figure 8:
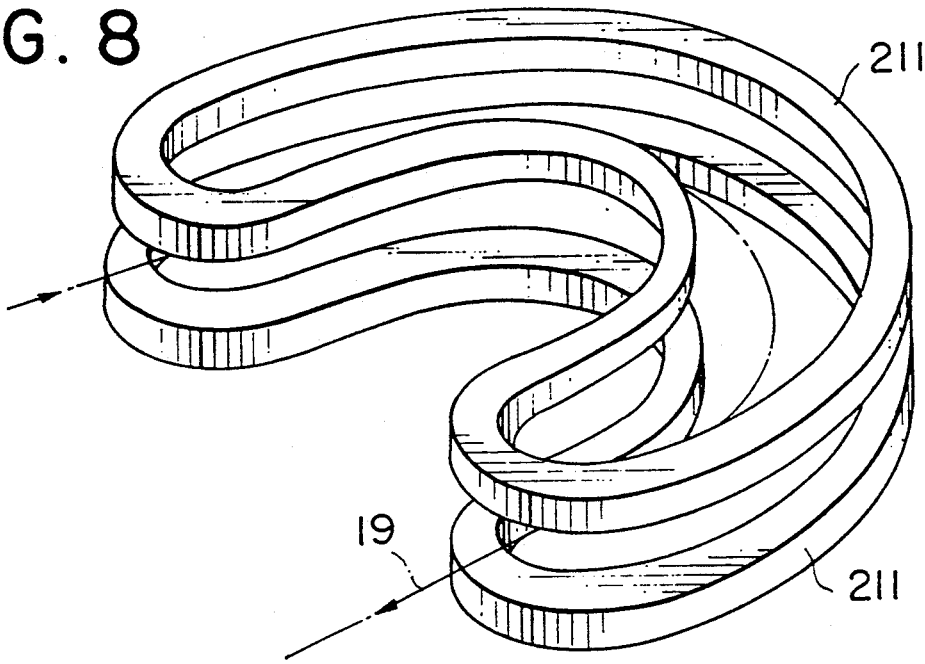
FIGS. 8 to 10 are respectively perspective views of the main coil, the quadrupole compensating shim coil and the sexpole compensating shim coil which are used in the bending magnet shown in FIG. 5.
Figure 9:
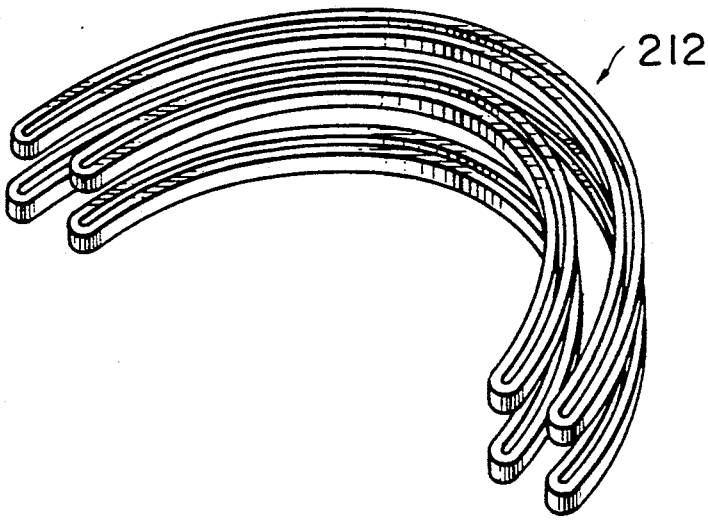
Figure 10:
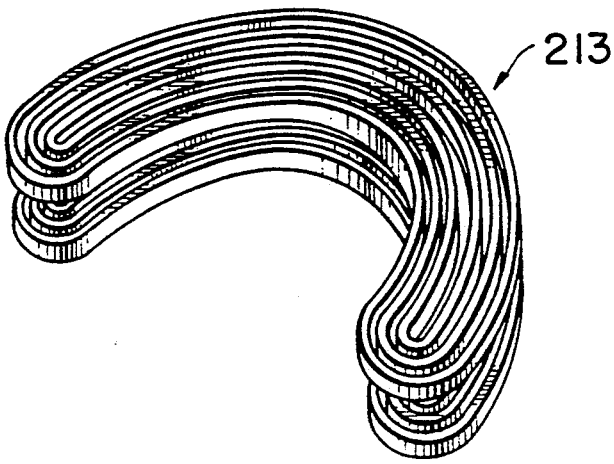

As shown in FIG. 8, the main deflecting coils 211 are so disposed as to hold the orbit 19 of the charged particles therebetween. The quadrupole compensating coils 212 and the sexpole compensating coils 213 respectively shown in FIGS. 9 and 10 are disposed within the main deflecting coils 211. Since these coils 211 to 213 are surrounded by the magnetic shield body 210, a main line of magnetic force 216 passes through the magnetic shield body 210, with scarcely any leakage of the magnetic field toward the outside of the bending magnet 21, as shown in FIG. 5 and 6.

The magnetic field (called a non-uniform magnetic field) which is generated on the orbit 19 of the charged particles and spatially changes is mainly composed of a quadrupole magnetic field component and a sexpole magnetic field component. Thus, it is possible to effectively cancel the non-uniform magnetic field of the main coils 211 by using the quadrupole compensating shim coils 212, as well as the sexpole compensating shim coils 213, as in the bending magnet 21. Since the shim coils 212 and 213 are disposed in the main coils 211, the size of the cryostat 214 can be reduced, and the size of the bending magnet 21 can thus be reduced.

Figure 11:
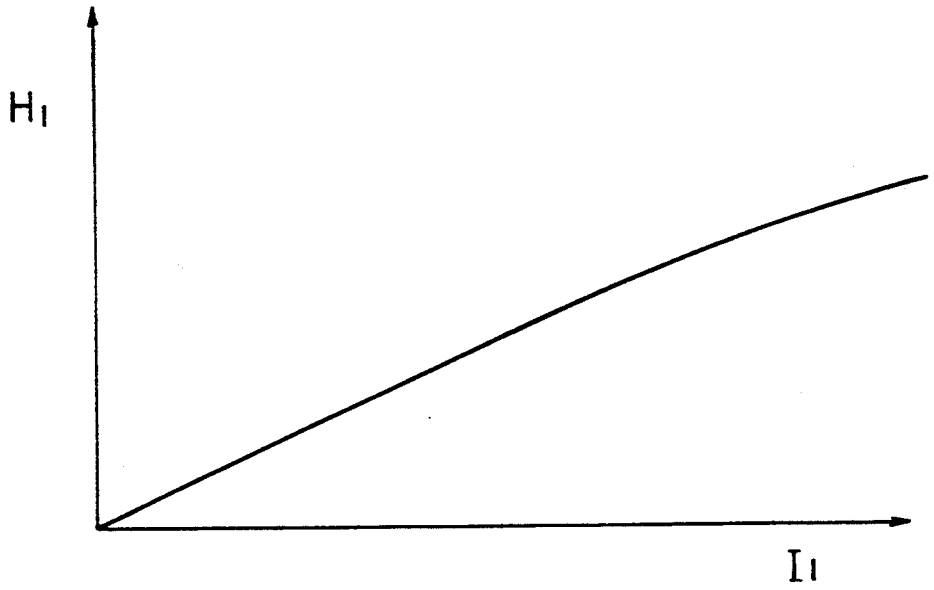
FIGS. 11 and 12 are graphs of the characteristics of the coils shown in FIGS. 8 and 9, respectively.
Figure 12:
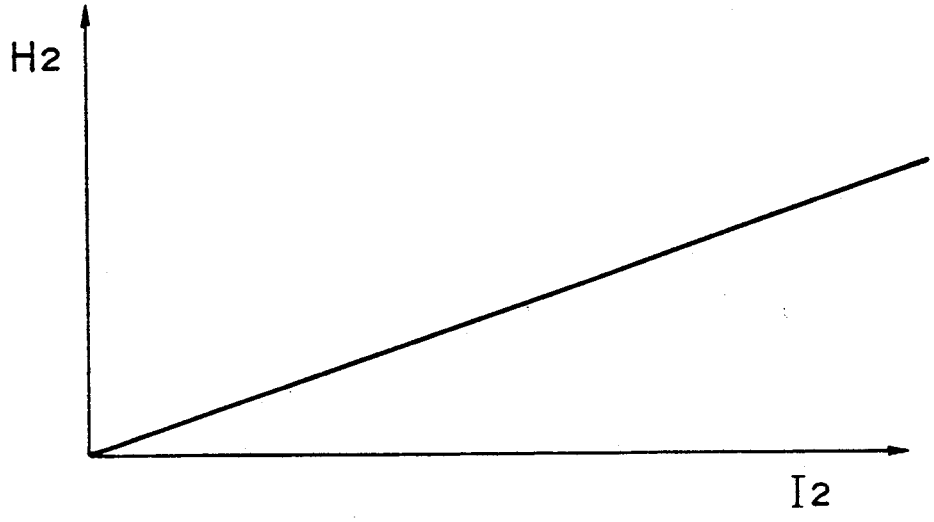

FIGS. 11 and 12 are graphs which respectively show the relationships between the exciting current $I_1$ and the generated magnetic field $H_1$ of the main coils 211 and between the exciting current $I_2$ and the generated magnetic field $H_2$ of the quadrupole compensating coils 212. In these graphs, it is assumed that the material used for the magnetic shield body 210 is iron. Since the most part of the magnetic flux produced by the main coils 211 passes through the magnetic shield body 210, when the exciting current $I_1$ is large, the magnetic shield body 210 is saturated. Thus, the rate of increase in the generated magnetic field $H_1$ is reduced as shown in FIG. 11. While, in FIG. 12, the exciting current $I_2$ and the generated magnetic field H2 have a substantially linear relationship because the most part of the magnetic flux produced by the quadrupole compensating coils 212 passes through the space in the cryostat 214. The exciting current and the generated magnetic field of the sexpole compensating coils 213 have also a substantially linear relationship in the same manner as in the case of the quadrupole compensating coils 212.

In order to provide a constantly uniform magnetic field generated on the orbit 19 of the charged particles, the non-uniform magnetic field generated by the main coils 211 should be always cancelled by using the magnetic field generated by the quadrupole compensating coils 212 and the magnetic field generated by the sexpole compensating coils 213. As described above, the magnetic field H1 generated by the main coils 211 has a characteristic of saturation, while the magnetic fields generated by the shim coils 212 and 213 have no saturation characteristic. It is therefore necessary to employ the waveform of the exciting current $I_1$ of the main coils 211 which is different from the waveforms of the exciting currents of the two shim coils 212 and 213 for the purpose of increasing the intensity of the magnetic field generated on a orbit 19 while maintaining it in a uniform state. The relationship of the currents of the shim coils 212 and 213 which enable a non-uniform magnetic field to be cancelled with the current $I_1$ of the main coils 211 are previously determined by experiments, and the current of each of the coils is changed so as to satisfy this relationship, whereby a uniform magnetic field can be always generated.

Figure 13:
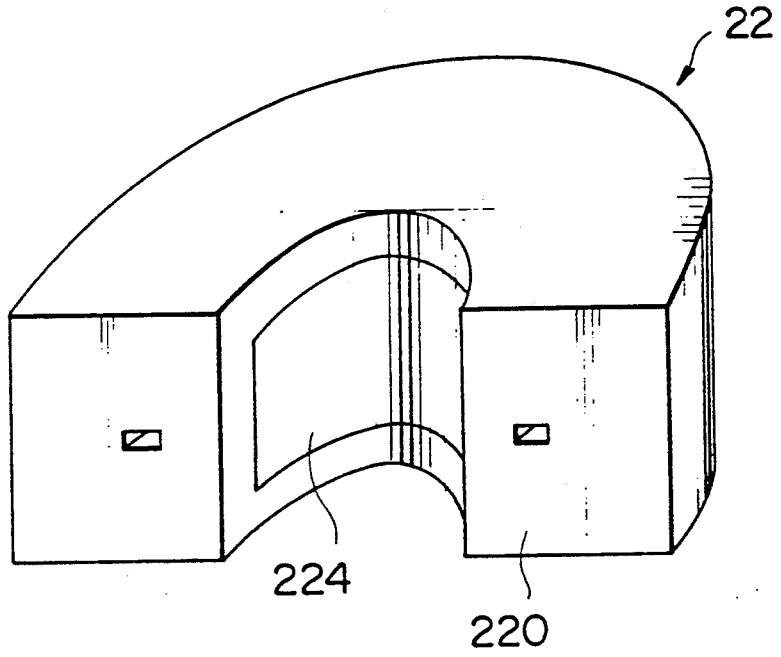
FIG. 13 is a perspective view of a third modification of a bending magnet.

Although the whole of the cryostat 214 is surrounded by the magnetic shield body 210 in the above-described bending magnet 21, as in the bending magnet 22 shown in FIG. 13, a horseshoe-shaped magnetic shield body 220 may be used in which the side surface thereof is partially exposed on the side of the center of curvature of a cryostat 224. Since the space where the side surface of the cryostat 224 is exposed has a small cross section through which the magnetic flux passes, the magnetic flux mainly passes through the portion in the magnetic shield body 220 on the side (outer periphery side) thereof opposite to the center of curvature of the cryostat 224. Even if no magnetic shield body 220 is provided on the side of the center of curvature, therefore, magnetic shield is sufficiently effected. Further, such a structure reduces the weight of the magnetic shield body 220.

Figure 14:
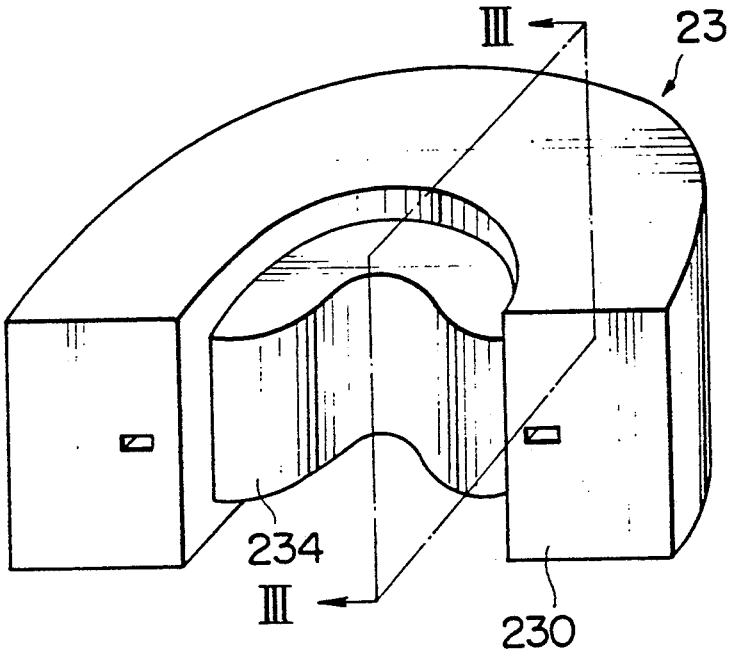
FIG. 14 is a perspective view of a fourth modification of a bending magnet.
Figure 15:
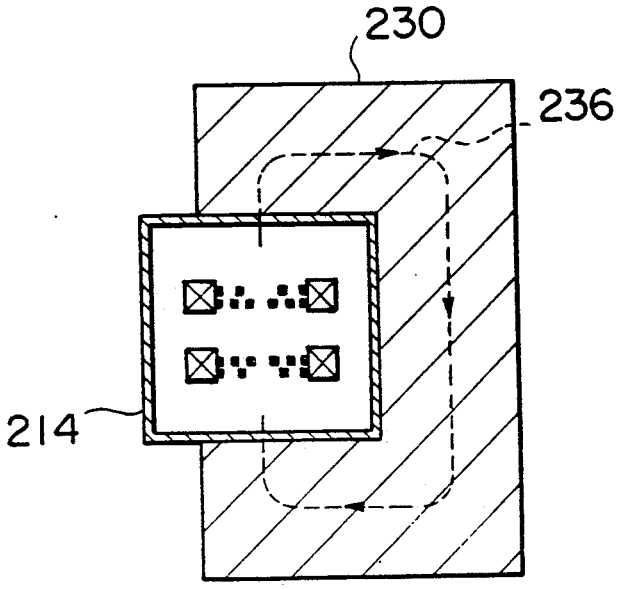
FIG. 15 is a sectional view taken along the line III--III in FIG. 14.

In addition, as in the bending magnet 23 shown in FIGS. 14 and 15, part of a cryostat 234 may be projected from a magnetic shield body 230 to the outside thereof on the side of the center of curvature of the cryostat 234 so that the weight of the magnetic shield body 230 can be further reduced. In this case, since a main line of magnetic force 236 passes through the portion of the magnetic shield body 230 on the outer periphery side of the cryostat 234, magnetic shield is sufficiently effected.

Figure 16:
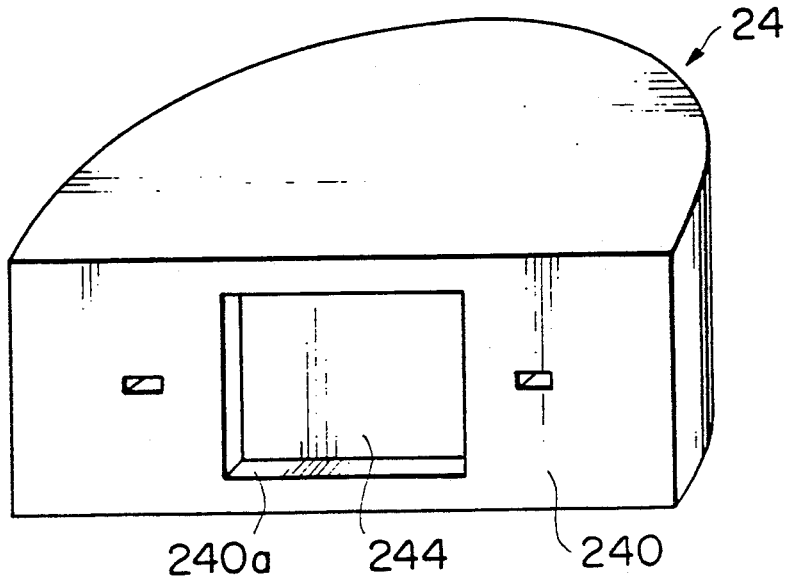
FIG. 16 is a perspective view of a fifth modification of a bending magnet.

Further, as shown in FIG. 16, both the magnetic shield body 240 and the cryostat 244 may be formed into semicircular cylinders so that the bending magnet 24 has a simple form and can be easily manufactured. In order to reduce the weight of this magnet 24, an opening portion **240*a* is formed in a part of the magnetic shield body 240 so that the side surface of the cryostat 244** is partially exposed on the side of the center of curvature thereof.

Figure 17:
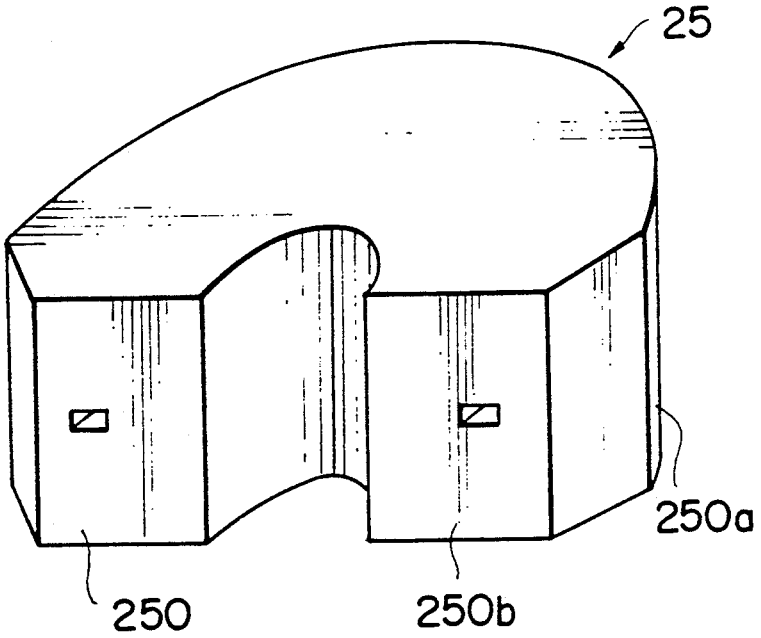
FIG. 17 is a perspective view of a sixth modification of a bending magnet.

In the bending magnet 25 shown in FIG. 17, the portions where the curved outer peripheral surface **250*a* of a magnetic shield body 250 intersects the plane side surfaces 250*b* thereof are chamfered. Since these portions are apart from each of the coils disposed in the magnetic shield body 250, chamfering has no significant influence on the magnetic shield effect and enables the reduction of the weight of the bending magnet 25**.

Although not shown in the drawings, a magnetic shield body may be installed in a cryostat. In addition, the shim coil is not limited to a quadrupole compensating or sexpole compensating. For example, coils which are capable of generating eight-pole or twelve-pole magnetic fields may be used.

Furthermore, the bending magnet is not limited to a superconductive electromagnet. Other electromagnets may be used.

What is claimed is:

1. A device for accelerating and storing charged particles comprising:

a vacuum duct which has two opposite linear portions and two opposite curved portions respectively connected to said linear portions and which functions to maintain the orbit of revolution of charged particles in a vacuum;

an accelerating means for accelerating charged particles which is disposed on said orbit of said charged particles;

a pair of bending magnets which are respectively disposed in said curved portions of said vacuum duct; and a pair of quadrupole electromagnets with one of said pair being the only quadrupole electromagnet disposed in one of said linear portions and the other of said pair being the only quadrupole electromagnet disposed in the other of said linear portions and at least one of said pair being disposed at a position at a given distance from the center of the corresponding linear portion.

2. A device according to claim 1, wherein said quadrupole electromagnets are respectively disposed at positions which each deviate from the center of the corresponding linear portion of said vacuum duct.

3. A device according to claim 2, wherein said quadrupole electromagnets are respectively disposed at positions at the same distance from the centers of the said linear portions of said vacuum duct in the same direction with respect to the direction of travel of said charged particles.

4. A device according to claim 1, wherein each of said bending magnets has a magnetic field gradient.

5. A device according to claim 4, wherein each of said bending magnets comprises a pair of main coils which hold the corresponding one of said curved portions of said vacuum duct therebetween and which have coil surfaces in parallel with each other, and a pair of iron cores each of which is inserted into the corresponding one of said main coils, said iron cores having pole faces opposing said corresponding one of said curved portions and at a certain angle with respect to each other.

6. A device according to claim 5, wherein said pole faces of said iron cores are disposed so as to open to the outside of said corresponding one of said curved portions of said vacuum duct.

7. A device according to claim 4, wherein each of said bending magnets comprises a pair of main coils for generating a magnetic field to deflect said charged particles, and multipolar compensating shim coils disposed near said main coils for generating multipolar magnetic fields.

8. A device according to claim 4, wherein each of said bending magnets comprises a pair of main coils formed along the corresponding one of said curved portions of said vacuum duct, multipolar compensating shim coils disposed near said main coils for generating multipolar magnetic fields, and a magnetic shield means for preventing the magnetic fields generated by said main coils and said multipolar compensating shim coils from leaking to the outside of each of said bending magnets.

9. A device according to claim 8, wherein said magnetic shield means comprises a magnetic shield body formed so as to surround the corresponding one of said curved portions of said vacuum duct and said main coils and said multipolar compensating shim coils.

10. A device according to claim 9, wherein said magnetic shield body is made of iron.

11. A device according to claim 9, wherein said magnetic shield body has the form of a horseshoe with a portion thereof in the vicinity of the center of curvature of said corresponding one of said curved portions of said vacuum duct being removed.

12. A device according to claim 9, wherein said magnetic shield body has the form of a semicircular cylinder.

13. A device according to claim 8, wherein said multipolar compensating shim coils are disposed in said main coils.

14. A device according to claim 8, wherein said multipolar compensating shim coils comprises quadrupole compensating coils and sexpole compensating coils.

15. A device according to claim 4, wherein each of said bending magnets is a superconductive electromagnet.

16. A device according to claim 15, wherein each of said bending magnets comprises a pair of main coils formed along the corresponding one of said curved portions of said vacuum duct, multipolar compensating shim coils disposed near said main coils for generating multipolar magnetic fields, a cryostat for surrounding said main coils and said multipolar compensating shim coils, and a magnetic shield means surrounding said cryostat for preventing the magnetic fields generated by said main coils and said multipolar compensating shim coils from leaking to the outside of each of said bending magnets.

17. A device according to claim 1 further comprising a septum electromagnet for injecting charged particles into said vacuum duct and a kicker electromagnet.

18. A device according to claim 17, wherein said septum electromagnet and said kicker electromagnet are respectively disposed in said linear portions of said vacuum duct.

19. A device for accelerating and storing charged particles comprising:

a vacuum duct which has two opposite linear portions and two opposite curved portions respectively connected to said linear portions and which function to maintain the orbit of revolution of charged particles in a vacuum;

an accelerating means for accelerating the charged particles which is disposed in said orbit of said charged particles;

a pair of bending magnets which are respectively disposed in said curved portions of said vacuum duct, wherein each of said bending magnets has a magnetic field gradient and wherein each of said bending magnets comprises a pair of main coils which hold the corresponding one of said curved portions of said vacuum ducts therebetween and which have coil surfaces at a certain angle with respect to each other; and a pair of quadrupole electromagnets which are respectively disposed on said linear portions of said vacuum duct and at least one of which is disposed at a position at a given distance from the center of the corresponding linear portion.

20. A device according to claim 19, wherein said coil surfaces of said two main coils are disposed so as to open to the outside of each of said curved portions of said vacuum duct.

* * * * *